US006397899B1

(12) United States Patent
Kobayashi et al.

(10) Patent No.: US 6,397,899 B1
(45) Date of Patent: Jun. 4, 2002

(54) TRANSFER FABRIC AND PAPERMAKING MACHINE USING THE SAME

(75) Inventors: Shogo Kobayashi, Fuji; Hiroyuki Nagura, Tokyo, both of (JP)

(73) Assignees: Kobayashi Engineering Works Ltd., Shizuoka; Nippon Filcon Co., Ltd., Tokyo, both of (JP)

( * ) Notice: Subject to any disclaimer, the term of this patent is extended or adjusted under 35 U.S.C. 154(b) by 0 days.

(21) Appl. No.: 09/493,245

(22) Filed: Jan. 28, 2000

(30) Foreign Application Priority Data

Jan. 29, 1999 (JP) ..... 11-057495

(51) Int. Cl.[7] ..... D21F 2/00
(52) U.S. Cl. ..... 139/383 A; 162/903
(58) Field of Search ..... 139/383 A; 162/903

(56) References Cited

U.S. PATENT DOCUMENTS 5,169,709 A * 12/1992 Fleischer ..... 428/225
5,360,518 A * 11/1994 McCarthy et al. ..... 139/383 A
5,429,686 A * 7/1995 Chiu et al. ..... 139/383 A
5,713,397 A * 2/1998 Quigley ..... 139/383 A
5,746,887 A * 5/1998 Wendt et al. ..... 162/109
6,234,213 B1 * 5/2001 Kobayashi et al. ..... 139/383 A
6,284,678 B1 * 9/2001 Kobayashi et al. ..... 442/207

* cited by examiner

*Primary Examiner*—Andy Falik
(74) *Attorney, Agent, or Firm*—Rader, Fishman and Grauer PLLC

(57) ABSTRACT

A transfer fabric for conveying wet paper from a sheet forming part to a hydro-extracting part and a papermaking machine using the same are disclosed. A transfer fabric for receiving from a paper forming fabric the wet paper formed by a sheet forming part and delivering the wet paper into a hydro-extracting part as the subsequent step. The transfer fabric is a clothed net produced by preparing as wefts such yarns having both monofilaments and plain threads of a small diameter so bound as to interpose water absorbing gaps therebetween on the running side face side and plain threads of a small diameter so bound as to interpose water absorbing gaps therebetween on the wet paper receiving face side, and as warps monofilaments or twisted monofilaments, laying the wefts in a plurality of layers and the warps in a single layer, and weaving the wefts and said warps.

13 Claims, 9 Drawing Sheets

TRANSFER FABRIC AND PAPERMAKING MACHINE USING THE SAME

BACKGROUND OF THE INVENTION

This invention relates to a transfer fabric for conveying wet paper from a sheet forming part to a hydro-extracting part and a papermaking machine using the fabric.

As means for receiving wet paper formed at a sheet forming part of a paper marking machine from a paper forming woven fabric of the machine and delivering the wet paper to a hydro-extracting part of the machine as the next step, a so-called needle felt obtained by applying vats of synthetic fibers one each to the obverse and the reverse face of a foundation formed by interweaving monofilaments or multifilaments and interlacing the vats by needling, and a wire which is a single-layer, double-layer woven fabric formed by using monofilaments have been known.

SUMMARY OF THE INVENTION

In a papermaking machine, delivery of wet paper is made at many places. This delivery process is generally effected by a forced aspirating device called transfer suction box or transfer suction roll. The method of harnessing the aspirating force is generally utilized because it is capable of most stably transferring wet paper. It nevertheless has disadvantages such as suffering the pressure of aspiration, when exerted more than that is proper, to extract fine fibers and filler together with water from the wet paper to the extent of adversely affecting the paper qualities, such as the evenness of surface smoothness on the obverse and the reverse side, curling property, and strength or inducing accelerated wear or abnormal wear on the paper forming woven fabric or felt. It also incurs higher cost for facilities and for maintenance and management thereof.

The needle felt has the vat densely gathered generally in the direction of z axis and, therefore, tends to accumulate fibers, filler, and chemical in the raw material for paper inside the body of felt. When a high-pressure washing shower is used for depriving the felt of such defiling substances, it tends to tear and bore holds in the vat of fibers and suffer from poor cleaning property. The papermaking machine of the type receiving the wet paper formed in the sheet forming part under nip pressure from the paper forming woven fabric and delivering the wet paper to the subsequent hydro-extracting part, therefore, is not allowed to increase the sheet forming speed but is prevented from improving the paper-producing property owing to the limited quality of the needle felt. For the purpose of conferring improved cleanability upon the needle felt, a woven fabric using monofilaments for both warps and wefts and keeping vats in an unneedled state have been tried. This woven fabric, however, has failed to withstand actual use because the transfer of water from the wet paper to the woven fabric is insufficient in the sheet forming part and the nip part and therefore the wet paper is not stably transferred to the woven fabric.

This invention, therefore, is aimed at providing a transfer fabric which is liberated from the drawback mentioned above and is enabled to manifest a satisfactory ability to transfer the wet paper and succumb fully to necessary cleaning and, as a result, improving the productivity of paper due to the use of this transfer fabric.

This invention relates to a transfer fabric used in a papermaking machine for receiving from a paper forming fabric the wet paper formed by a sheet forming part of the papermaking machine. The transfer fabric may be used for delivering the wet paper into a hydro-extracting part of the machine as the subsequent step. The transfer fabric is a clothed net produced by weaving plain yarn wefts of a small diameter so bound as to interpose water absorbing gaps therebetween on the running face side thereof and plain yarn wefts of a small diameter so bound as to interpose water absorbing gaps therebetween on the wet paper receiving face side and monofilament or twisted monofilament warps. The wefts are in a plurality of layers and the warps are in a single layer.

The warps of this invention can be monofilaments on the running face side of the fabric and can be monofilaments and/or plain yarns of a small diameter so bound as to interpose water absorbing gaps therebetween on the wet paper receiving face side of the fabric. The wefts can be disposed in a plurality of layers and the warps can be disposed in a plurality of layers.

The plain yarn wefts can be spun yarns, multifilaments, taslan finished yarns, twisted monofilaments, mole yarns, filament-processed yarns, yarns having spun yarns would on core lines of monofilaments, yarns having multifilaments wound on core lines of monofilaments, or yarns produced by co-twisting at least two kinds of yarns selected from any of yarns mentioned above.

A transfer fabric of the present invention may receive from the paper forming woven fabric wet papers formed by a plurality of sheet forming parts and delivers to the hydro-extracting part as the subsequent step the wet papers sequentially superposed in a plurality of layers.

The transfer fabric of this invention will be discussed more in detail below.

DETAILED DESCRIPTION OF THE PREFERRED EMBODIMENTS

Figure 1:
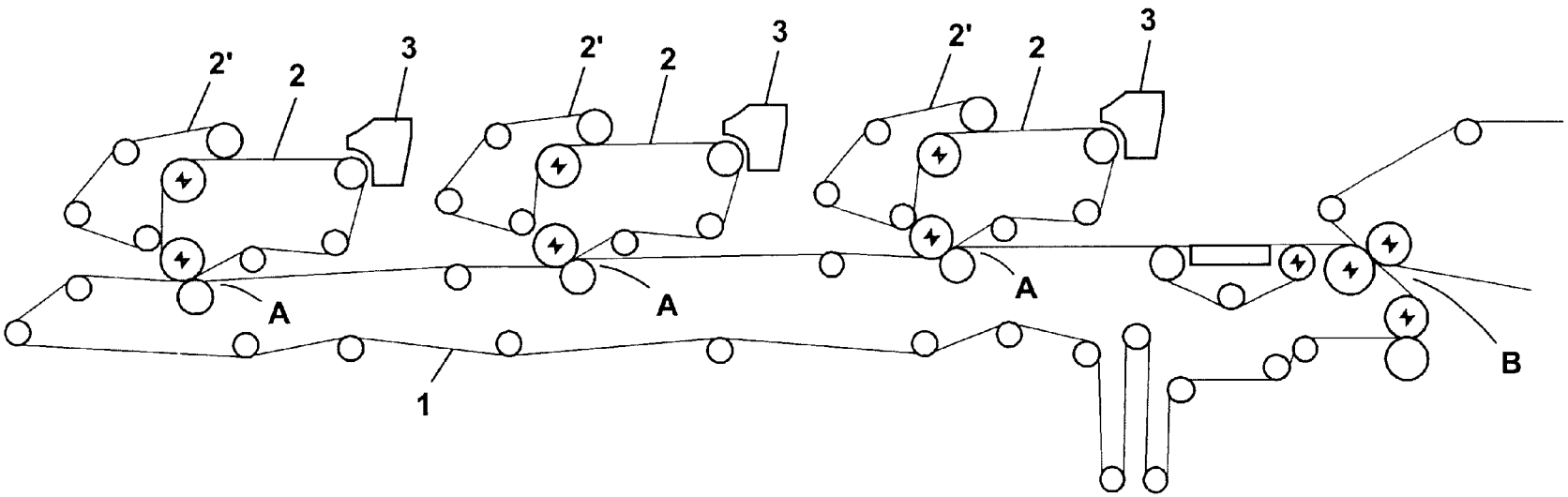
FIG. 1 is a schematic diagram illustrating one example of the papermaking machine using the transfer fabric of this invention.

For the transfer fabric in this invention to ensure stable delivery of the wet paper, the invention needs to utilize the characteristics of the transfer fabric, which is responsible for receiving the wet paper. The factors that determine the transferability of wet paper are the transfer fabric's surface density, area of contact with wet paper, ability to remove water from wet paper, etc. Particularly, the ability to remove water is important.

When the delivery of wet paper is effected by virtue of the nip pressure between two rolls, it is suspected that the nip pressure compresses the wet paper having a water content of about 85% and the transfer fabric playing the role of receiving the wet paper and that, after the rolls have loosed the pressure, the wet paper is transferred from the side of the paper forming woven fabric which has weak capillary attraction, namely the power to aspirate water from the wet paper, to the side of the transfer fabric which has a strong capillary attraction.

As viewed exclusively from the standpoint of this object, the needle felt which is filled throughout the entire depth from the obverse to the reverse surface thereof with a vat of fine synthetic fibers and, as a consequence, vested with high compressibility may well be rated as an optimum fabric on the receiving side. The fact that the water is aspirated from the wet paper as described above, however, automatically means that fine fibers, filler, chemical, etc. which are lodged in the wet paper enter the felt and that the felt must be cleaned. The dirt which has entered the felt defies removal and causes uneven spots and marks of dewatering because the felt has such a structure as is filled with a vat of fine synthetic fibers. When a high-pressure cleaning shower is used, the impact of the pressure of water tears and opens holes in the vat of fibers.

When a single layer woven fabric constructed by using monofilaments offering high resistance to the impact of the high-pressure cleaning shower for both warps and wefts or a two-ply woven fabric of wefts is adopted for the receiving side fabric with due consideration for the cleanability, the delivery of wet paper becomes unstable and the wet paper sustains breakage to the extent of degrading the rate of paper forming even when this fabric has finer mesh than the paper forming woven fabric. This phenomenon may be logically explained by a supposition that the fibers of paper, during the formation of a sheet of paper, thrust into the intersecting parts of the warps and wefts of the woven fabric and, as a consequence, the wet paper is not easily peeled from the paper forming woven fabric or it is not easily transferred even when the woven fabric on the wet paper receiving side has high surface density and contact area. An effort to stabilize the transfer by using a forced aspirating device results in degrading the quality of paper, aggravating the wear of the paper forming woven fabric, and posing the problem of a high cost of equipment and maintenance and management thereof.

To solve these problems, this invention, which was described in Japanese Patent Application No. 9-238798 filed earlier, contemplated using the construction of a clothed net having no use for a vat, namely by using on the wet paper receiving face side thereof such yarns as, for example, spun yarns, multifilaments, raising yarns, twisted monofilaments, mole yarns, filament-processed yarns, yarns having spun yarns wound on core lines of monofilaments, yarns having multifilaments wound on core lines of monofilaments, and yarns produced by co-twisting at least two species of yarns selected from thereamong and interweaving the yarns thereby giving rise to a multiplicity of capillary gaps in the fabric, improving the fabric in the ability to absorb water from the wet paper, heightening the power of the fabric to aspirate the wet paper, and stabilizing the reception of the wet paper and, meanwhile, using on the running face side thereof a reticular structure formed mainly of monofilaments thereby forming a polyfunctional woven fabric capable of securing three-dimensional empty spaces for easy passage of cleaning shower. This earlier filed invention disclosed in Japanese Patent Application No. 9-238798 made by the same applicants was widely accepted and used.

If papermaking speed is increased, however, water content ratio of the wet paper at a transfer area to a following press part, a part for dewatering, which tends to cause irregular release or cut of the paper. Further, paper crush may occur at the press part due to high water content ratio.

The inventors of this invention found that the earlier transfer fabric which was applied for a patent exhibited excellent water relocation from a wet paper to the transfer fabric, like a needle felt, by means of nip pressure and capillary attraction, as described in the specification. Therefore, the inventors thought that water removal efficiency of a water remover at the post transfer process was not sufficient. In other words, due to high water retaining capability of a paper receiving face of the transfer fabric, water could not be transferred to a running side of the fabric, which caused insufficient water removal from a wet paper.

Particularly, for lowering water of a wet paper, capillary attraction gaps to be formed at a running side face of the transfer fabric play more effective roles than net dewatering gaps opened at the running side face, to remove the water retained at a wet water receiving side of the fabric and to transfer the water to its running side. The present invention therefore provides the transfer fabric produced by weaving plain yarn wefts of a small diameter so bound as to interpose water absorbing gaps therebetween on the running face side thereof, in addition to the wet water receiving side of the transfer fabric. The plain yarns of a small diameter so bound as to interpose water absorbing gaps are disposed on the running face side in addition to the wet paper receiving side, which makes continuous capillary attraction gaps from the wet paper receiving side to the running side of the transfer fabric and mobility of water to the running side in an efficient way. Water which has moved to the running face side is effectively removed by a hydro-extracting device located at the running face side without leak of suction force, whereby extraction of water is effectively conducted and water content in the wet paper can be lowered.

Further, this invention is furnished on the running face side with a reticular structure of monofilaments and, therefore, is enabled to acquire high rigidity for a woven fabric and diminish the dimensional changes (elongation in the direction of length and contraction in the direction of width). Number ratio of yarns between or arrangement order of monofilaments and plain yarn wefts of a small diameter so bound as to interpose water absorbing gaps therebetween may be determined depend on usage conditions.

If a ratio of monofilament is made larger, the rigidity and durability of the transfer fabric increase. If a ratio of plain yarns of a small diameter so bound as to interpose water absorbing gaps is made larger, the mobility of water from the wet paper receiving side to the running side of the transfer fabric becomes more effective.

The term "spun yarn" as used in the present specification means what is obtained by bundling short fibers into a thread, namely a yarn produced by spinning, for example. The term "multifilament" means what is obtained by bundling fine short fibers into a thread, the term "raising yarn" means what is obtained by scratching and scuffing the surface of multifilaments with a needle-like object, and the term "filament-processed yarn" means a threadlike object obtained by subjecting filaments to such processings as stretching, bulking, and crimping and embraces yarns generally referred to as textured yarn, bulky yarn, and stretched yarn and even embraces wooly nylon. The term "mole yarn" means what is obtained by having short fibers disposed radially around the core of multifilament as the center. This term embraces what is produced by subjecting the radially disposed short fibers to a crimping treatment.

The needle felt gradually contracts with loss of thickness and suffers gradual decrease in the ability to aspirate water in accordance as the cumulative duration of service increases. This invention incurs only sparing decrease in thickness and maintains a satisfactory ability to aspirate water until the termination of service life because the clothed net has high rigidity. As respects the resistance to the high-pressure cleaning shower, the vat of the needle felt is easily broken and expelled and compelled to sustain holes by the impact of the water of shower because this vat, though partially intertwined into the foundation, fundamentally has the individual fibers loosely interlaced mutually.

In contrast, the transfer fabric of this invention in its entirety has the construction of a clothed net, though the yarns forming the surface thereof are severally an aggregate of fine fibers similarly in the vat of the needle felt. Owing to this construction, the transfer fabric is neither broken or expelled by the impact of shower water because the wefts are interwoven in a short cycle into the warps and strongly restrained thereby and, by the same token, the warps into the wefts. This resistance to the impart of the high-pressure shower is another effect derived from the use of the construction of a clothed net for the wet paper receiving face.

The pattern of weaving is not particularly limited so long as the warps form layers of monofilaments or twisted monofilaments and the wefts have on the wet paper receiving face side thereof such yarns as are formed by binding plain threads of a small diameter in such a manner as to interpose water-absorbing gaps therebetween, and have on the running face side thereof monofilaments and such yarns as are formed by binding plain threads of a small diameter in such a manner as to interpose water absorbing gaps therebetween so disposed in a multiplicity of layers. Various constructions such as the combination of one ply of warps and two plies of wefts, combination of one ply of warps and three plies of wefts, combination of two plies of warps and three piles of wefts, and the construction of two layers each combining two plies of warps and two plies of wefts can be adopted.

Such yarns as are formed by binding plain threads of a small diameter in such a manner as to interpose water-absorbing gaps therebetween can be spun yarns, multifilaments, raising yarns, twisted monofilaments, mole yarns, filament-processed yarns, yarns having spun yarns wound on core lines of monofilaments, yarns having multifilaments wound on core lines of monofilaments, and yarns produced by co-twisting at least two species of yarns selected from thereamong.

The layer of monofilaments or twisted monofilaments in the warps fulfills the role of improving rigidity and dimensional stability and the monofilaments on the running face side the role of improving rigidity and resistance to abrasion. Such yarns as are formed by binding plain threads of a small diameter in such a manner as to interpose water-absorbing gaps therebetween fulfill the role of absorbing water contained in a wet paper. When the wefts on the running face side are made of polyamide, they excel in resistance to the pressure of nip and to the abrasion.

Polyester is adopted where rigidity forms an important consideration. Where the reconciliation of the two sets of properties is to be taken into account, polyamide and polyester may be alternately disposed. Where the warps are to be formed in two layers, those on the running face side may be monofilaments and those on the wet paper receiving face side such yarns as are obtained by binding plain threads so as to interpose water-absorbing gaps therebetween. The monofilaments on the running face mainly promote the improvement in rigidity and dimensional stability and the yarns on the wet paper receiving face side which result from winding plain threads so as to interpose water-absorbing gaps therebetween promotes the improvement in the ability to remove water.

An intermediate layer formed of monofilaments or of the same wefts as used on the wet paper receiving face side may be interposed between the wet paper receiving face side and running face side of wefts for the purpose of enabling the woven fabric to acquire cushionability and improved ability to remove water. Depending on the conditions being sought, the disposition of monofilaments may be relied on to improve the rigidity and the deposition of such yarns as are produced by binding plain threads of a small diameter so as to interpose water-absorbing gaps therebetween similarly to the wet paper receiving face side may be relied on to improve further the ability to absorb water. The quality intermediate the two sets of properties mentioned above may be attained by alternately disposing monofilaments and such yarns as are produced by binding plain threads of a small diameter so as to interpose water-absorbing gaps therebetween.

Multi-layered intermediate layers may further improve cushionability and nip resisting property. Yarns used in the intermediate layers can be selected in the same manner based on the properties sought and are not limited to a particular ones. It is preferred, however, to have monofilaments disposed in either upper or lower layer of the multi-layered intermediate layers. For example, wefts on an upper-intermediate layer can be alternately disposed monofilaments and such yarns as are produced by binding plain threads of a small diameter so as to interpose water-absorbing gaps therebetween, whereas wefts on a lower-intermediate layer can be such yarns as are produced by binding plain threads of a small diameter so as to interpose water-absorbing gaps therebetween.

Manner of piling up of wefts and number density (number of yarns per unit length) thereof can be freely selected based on properties sought. If, for example, wefts in an intermediate layer and in a running face side layer are piled up in a deviated manner, the running side face wefts slightly enter into spaces between intermediate layer wefts, which make the transfer fabric thinner and excellent mobility of water from the wet paper receiving face side to the running face side can be achieved.

EXAMPLES

The embodiments of this invention will be described with reference to working examples illustrated in the accompanying diagrams.

Figure 2:
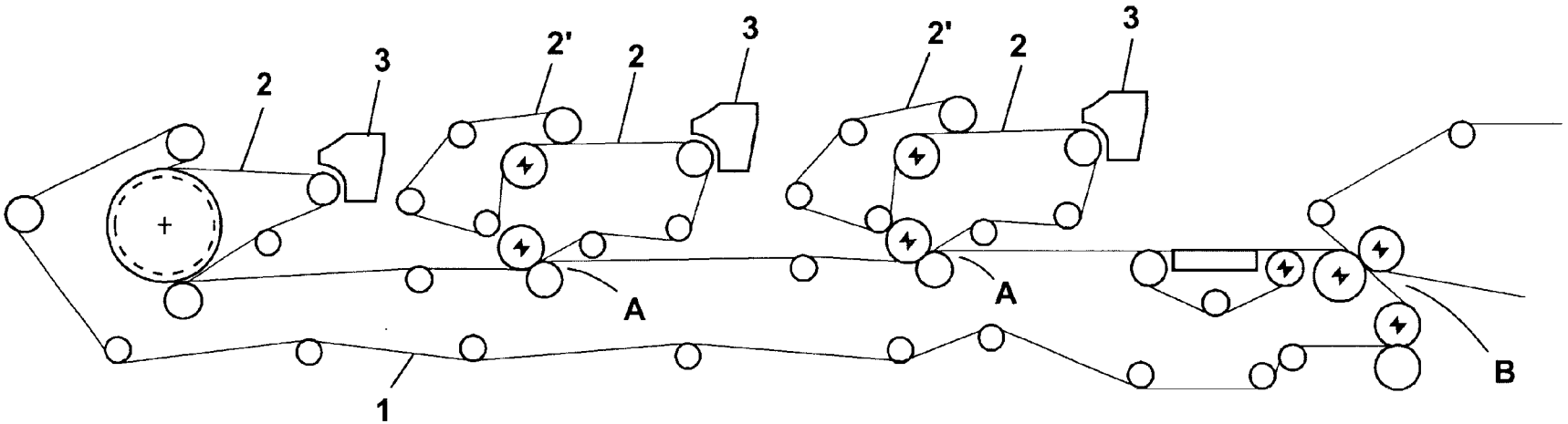
FIG. 2 is a schematic diagram illustrating another example of the papermaking machine using the transfer fabric of this invention.

FIGS. 1 and 2 are schematic diagrams illustrating a papermaking machine using a transfer fabric 1 of this invention.

With reference to FIG. 1, the pulp slurry elected from a head box 3 is dewatered by paper forming woven fabrics 2 and 2', the wet paper consequently formed is received by the transfer fabric 1 by virtue of the nip pressure in the wet paper receiving part A. The plurality of wet papers thus formed are sequentially superposed and delivered to a hydro-extracting part (press part) B. In the part A, the wet papers are transferred to the transfer fabric. The A part has a nip pressure in the range of 3.5–7 kg/cm and is not fitted with a forced aspirating device.

FIG. 2 depicts another working example, which is identical with that of FIG. 1, excepting that the transfer fabric plays the role of removing water and forming a base in the place of the paper forming woven fabric 2' on the left end side of the sheet forming machine.

Figure 3:
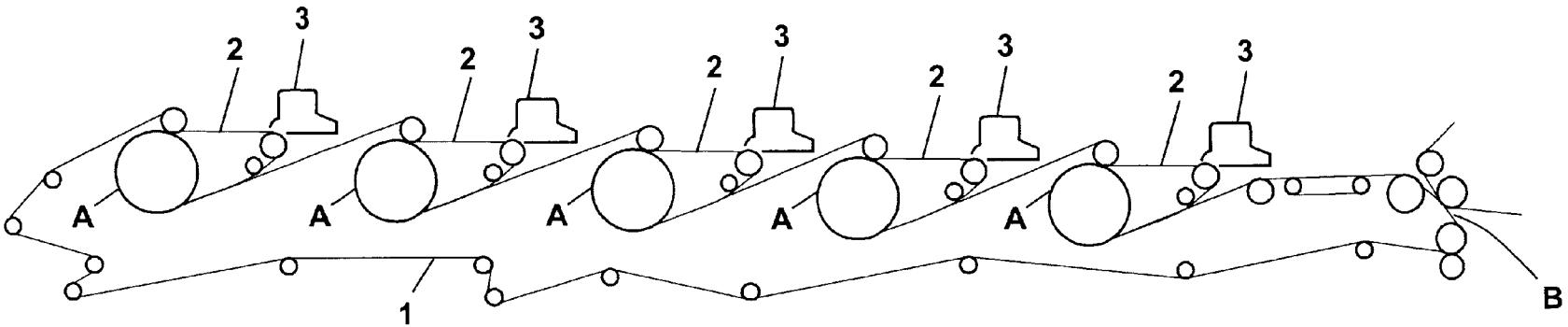
FIG. 3 is a schematic diagram illustrating still another example of the papermaking machine using the transfer fabric of this invention.

FIG. 3 depicts still another working example which attains the transfer of the wet paper from the paper forming woven fabric 2 to the transfer fabric 1 by virtue of the pressure of contact of faces. It is not furnished with a forced aspirating device or a roll nip.

Figure 4:
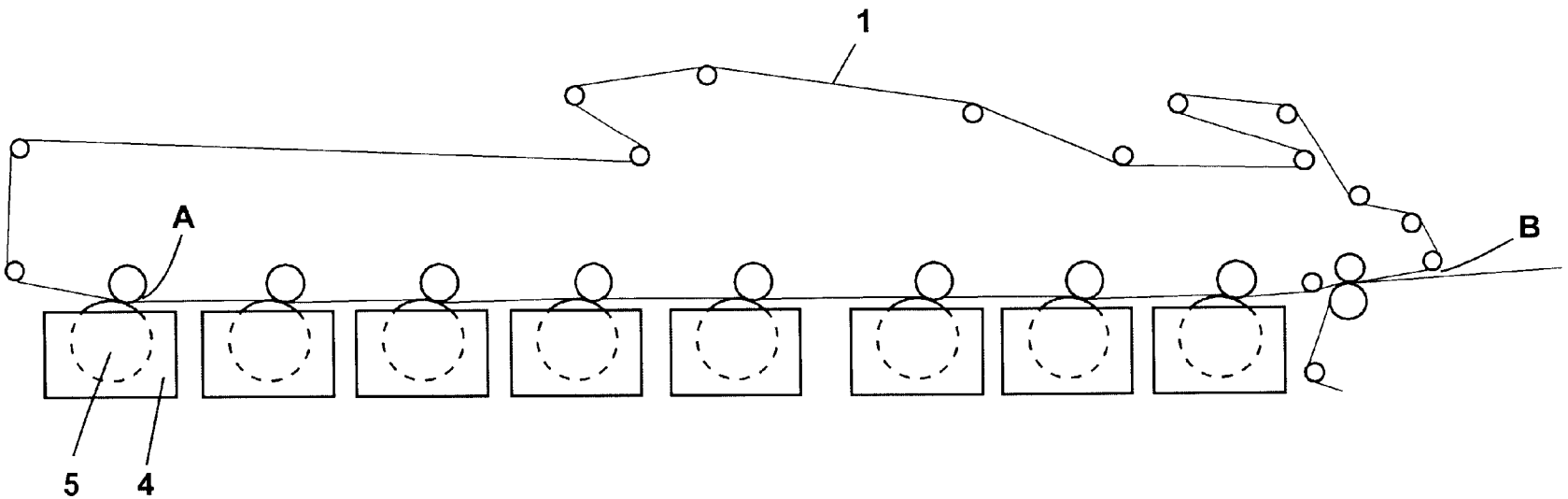
FIG. 4 is a schematic diagram illustrating yet another example of the papermaking machine using the transfer fabric of this invention.

FIG. 4 represents yet another working example using the transfer fabric 1 for receiving the wet paper formed in a reticular cylinder 5 in the wet paper receiving part A by virtue of the nip pressure and sequentially superposing the wet papers, and delivering the superposed wet papers into the hydro-extracting part B.

Figure 5:
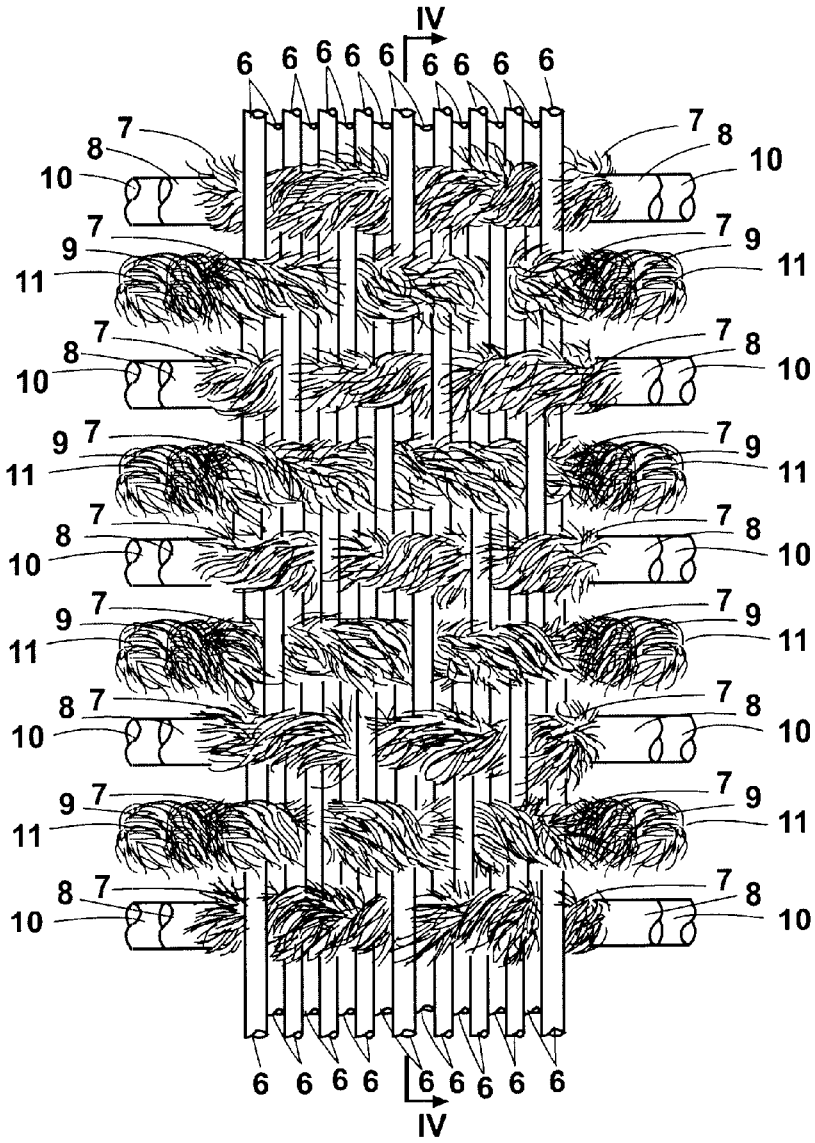
FIG. 5 is a plan view illustrating one example of the transfer fabric of this invention.
Figure 6:
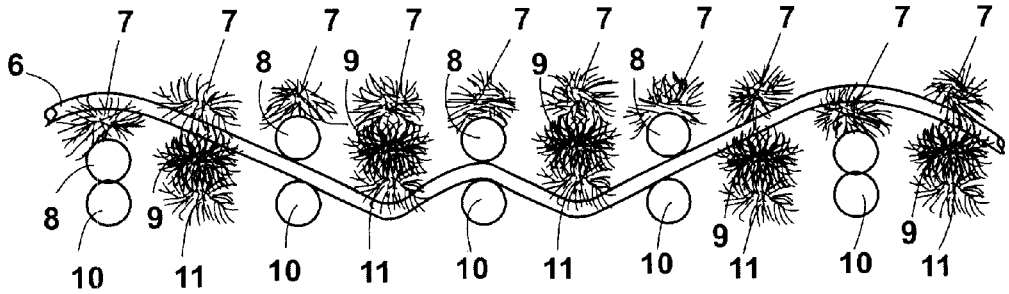
FIG. 6 is a cross section along the line VI—VI FIG. 5 which is in parallel to the warp direction.

FIG. 5 is a plan view illustrating one example of the 5 transfer fabric according to this invention and FIG. 6 is a cross section taken along the line VI—VI of FIG. 5 which is parallel to the warps.

For warps 6, 90 polyamide monofilaments, 0.35 mm in diameter, are disposed per inch. For wet paper receiving face side wefts 7, 22 yarns each obtained by co-twisting two polyamide raising yarns, 540 deniers each in fineness, and a crimped yarn of polyamide multifilaments, 800 deniers in fineness, are disposed per inch. For intermediate layer wefts, 22 polyester monofilaments 8, 0.45 mm in diameter, and polyester mole yarns 9, 1.0 mm in diameter in appearance, are alternately disposed per inch. For running face side wefts, 22 polyamide monofilaments 10, 0.35 mm in diameter, and yarns 11 each obtained by co-twisting two polyamide raising yarns, 540 deniers each in fineness, and a crimped yarn of polyamide multifilaments, 800 deniers in fineness, are alternately disposed per inch. They jointly form a fabric having eight shafts of weave of the combination of one ply warps and three plies of wefts in a repeating unit.

Figure 7:
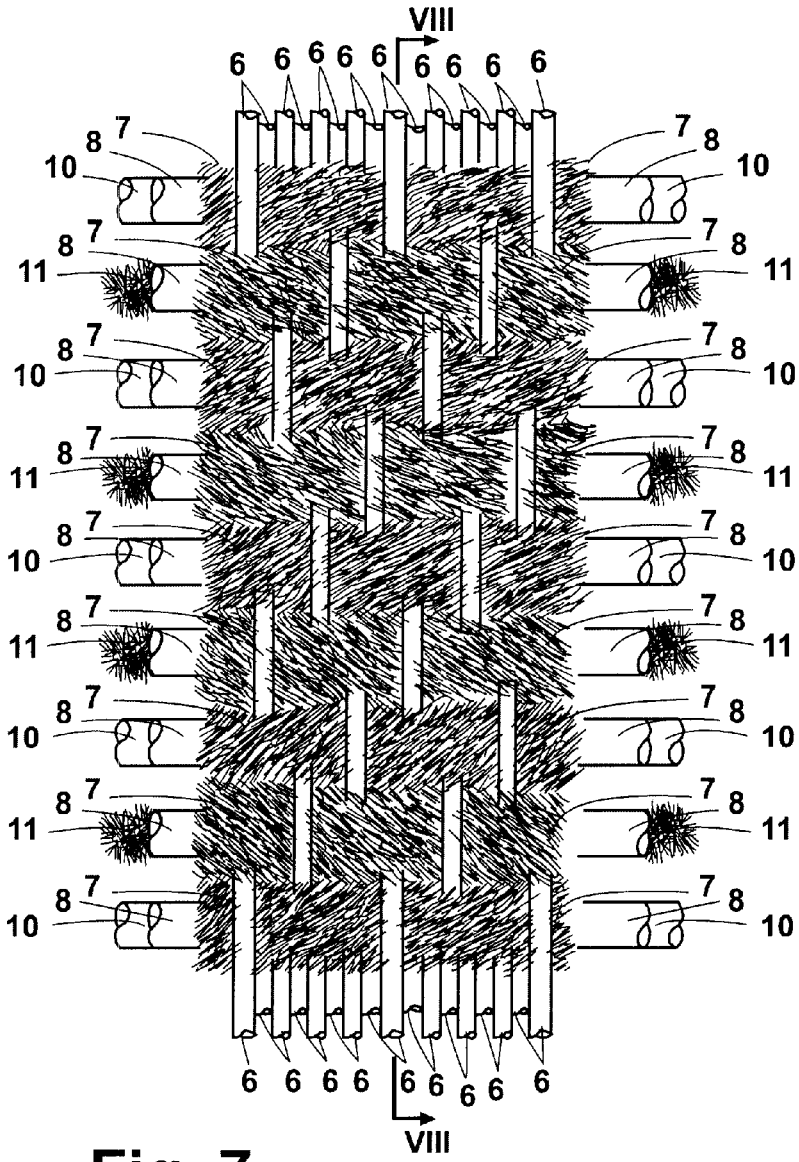
FIG. 7 is a plan view illustrating one example of the transfer fabric of this invention.
Figure 8:
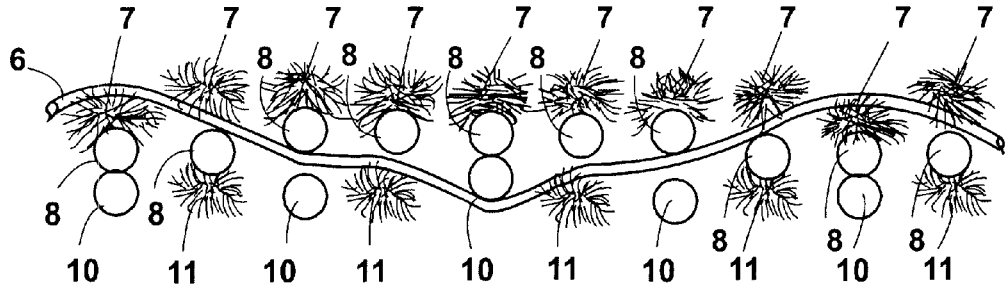
FIG. 8 is a cross section along the line VIII—VIII in FIG. 7, which is in parallel to the warp direction.

FIG. 7 is a plan view illustrating one example of the transfer fabric of this invention and FIG. 8 is a cross section taken along the line VIII—VIII of FIG. 7 is parallel to the warps.

For warps 6, polyester monofilaments are disposed. For wet paper receiving face side wefts 7, polyamide spun yarns are disposed. For intermediate layer wefts 8, polyamide monofilaments are disposed. For running face side wefts, polyamide monofilaments 10 and yarns 11 each obtained by co-twisting two polyamide raising yarns and a crimped yarn of polyamide multifilaments, are alternately disposed. Thus, a fabric of eight shafts having the combination of one ply of warps and three plies of wefts in a repeating unit is obtained.

Figure 9:
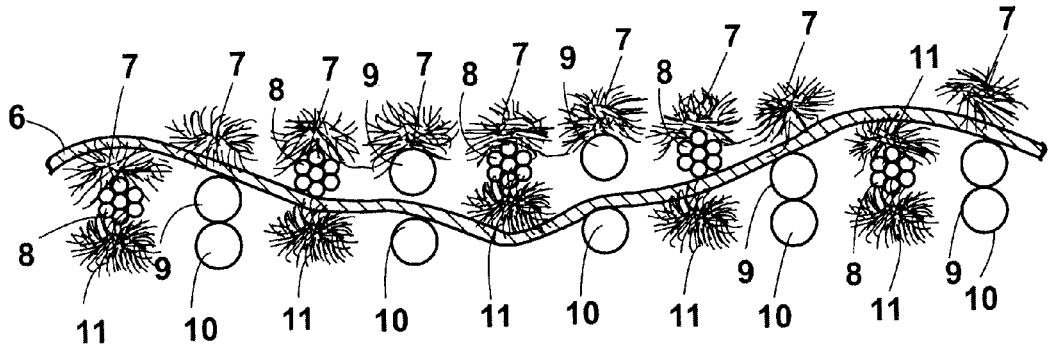
FIG. 9 is a cross section illustrating another example of the transfer fabric of this invention as taken through the fabric along the warp direction.

FIG. 9 is a cross section illustrating another example of the transfer fabric of this invention, as taken along the direction of warps.

For warps 6, twisted polyester monofilaments are disposed. For wet paper receiving face side wefts 7, polyamide spun yarns are disposed. For intermediate layer wefts, twisted polyamide monofilaments 8 and polyamide monofilaments 9 are alternately disposed. For running face side wefts, polyamide monofilaments 10 and yarns 11 each obtained by co-twisting two polyamide raising yarns and a crimped yarn of polyamide multifilaments, are alternately disposed. Thus a fabric of eight shafts having three piles of wefts in a repeating unit is obtained.

Figure 10:
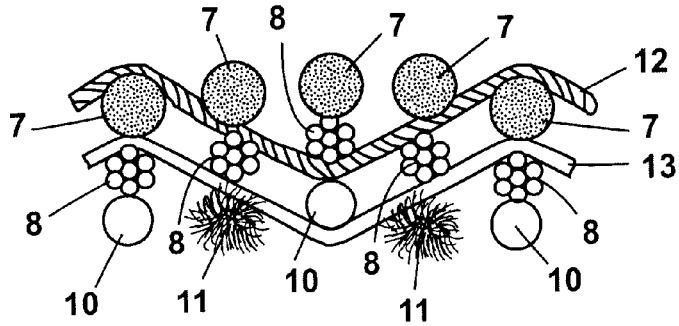
FIG. 10 is a cross section illustrating still another example of the transfer fabric of this invention as taken through the fabric along the warp direction.

FIG. 10 is a cross section illustrating still another example of the transfer fabric of this invention, taken along the direction of warps. For wet paper receiving face side warps 12, polyamide multifilaments are disposed. For running face side warps 13, polyester monofilaments are disposed. For wet paper receiving face side wefts 7, polyamide multifilaments are disposed. For intermediate layer wefts 8, twisted polyamide monofilaments are disposed. For running face side wefts, polyamide monofilaments 10 and polyamide mole yarns 11 are alternately disposed. Thus, a fabric of eight shafts having a fabric having the combination of two plies of warps and three plies of wefts in a repeating unit is obtained.

Figure 11:
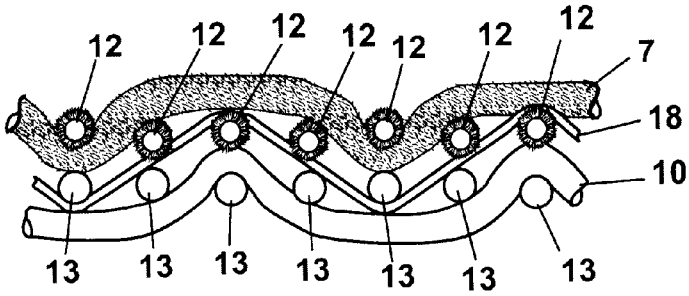
FIG. 11 is a cross section illustrating yet another example of the transfer fabric of this invention as taken through the fabric along the weft direction.

FIG. 11 is a cross section illustrating a further example of the transfer fabric of this invention taken along the direction of wefts.

For wet paper receiving face side warps 12, yarns having polyamide spun yarns wound around the core yarns of polyester monofilaments are disposed. For running face side warps 13, polyester monofilaments are disposed. For wet paper receiving face side wefts 7, wooly nylon yarns are disposed. For running face side wefts 10, polyamide monofilaments and polyester spun yarns (not shown) are alternately disposed. For binding yarns 18, polyamide monofilaments are disposed. Thus, a fabric of eight shafts having a two-layer woven fabric with two plies of warps and two plies of wefts is obtained.

Figure 12:
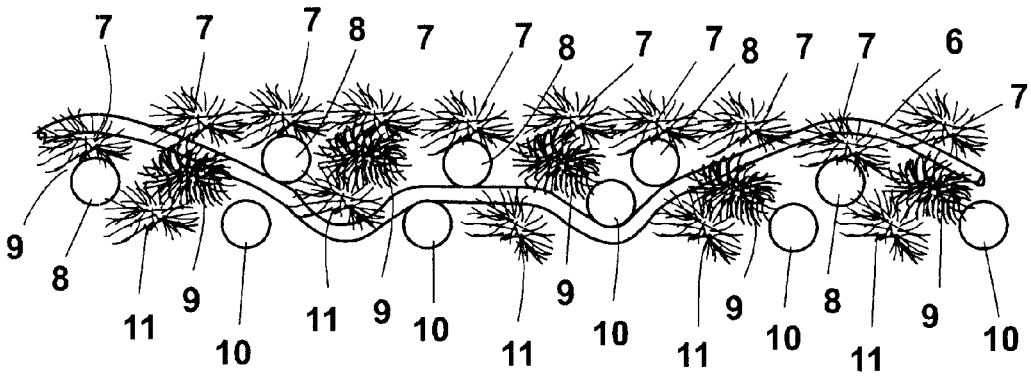
FIG. 12 is a cross section illustrating another example of the transfer fabric of this invention as taken through the fabric along the warp direction.

FIG. 12 is a cross section illustrating a further example of the transfer fabric of this invention taken along the direction of wefts. For warps 6, polyamide monofilaments are disposed. For wet paper receiving face side wefts, yarns 7 each obtained by co-twisting two polyamide rising yarns and a crimped yarn of polyamide multifilaments are disposed. For intermediate layer wefts, polyester monofilaments 8 and polyester mole yarns 9 are alternately disposed. For running face side wefts, polyamide monofilaments 10 and yarns 11 each obtained by co-twisting two polyamide raising yarns and a crimped yarn of polyamide multifilaments are disposed in an alternately deviated manner against the intermediate layer wefts. Thus a fabric of eight shafts having single ply of warps and three plies of wefts in a repeating unit is obtained.

Figure 13:
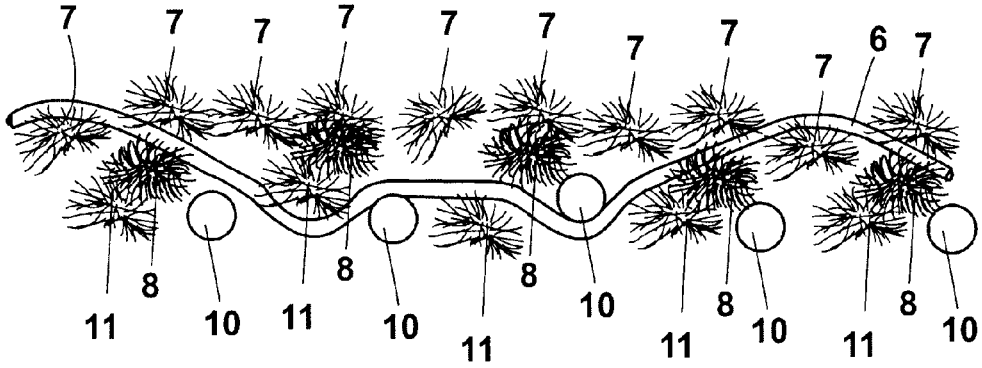
FIG. 13 is a cross section illustrating still another example of the transfer fabric of this invention as taken through the fabric along the warp direction.

FIG. 13 is a cross section illustrating a further example of the transfer fabric of this invention taken along the direction of wefts. For warps 6, polyamide monofilaments are disposed. For wet paper receiving face side wefts, yarns 7 each obtained by co-twisting two polyamide raising yarns and a crimped yarn_of polyamide multifilaments are disposed. For intermediate layer wefts, polyester mole yarns 8 are disposed in as half density as that of wet paper receiving face side wefts and running face side wefts. For running face side wefts, polyamide monofilaments 10 and yarns 11 each obtained by co-twisting two polyamide raising yarns and a crimped yarn of polyamide multifilaments are disposed in an alternately deviated manner against both the wet paper receiving face side wefts and intermediate layer wefts. Thus a fabric of eight shafts having single ply of warps and three plies of wefts in a repeating unit is obtained.

Figure 14:
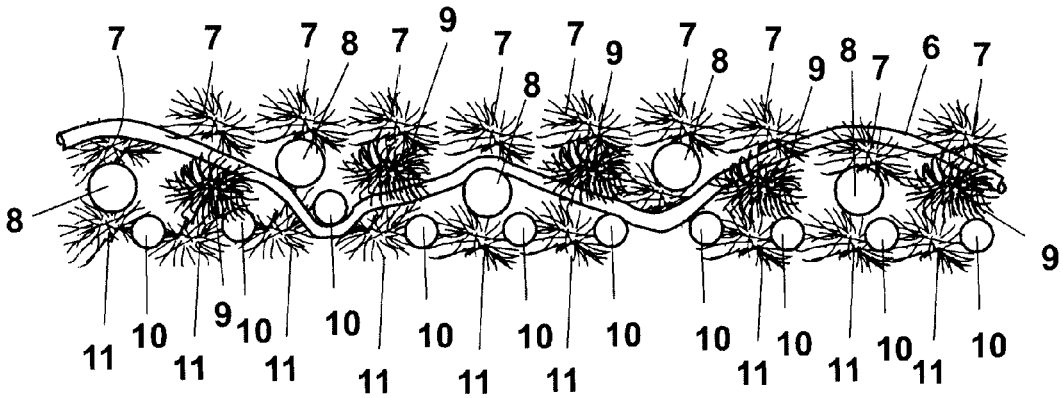
FIG. 14 is a cross section illustrating yet another example of the transfer fabric of this invention as taken through the fabric along the weft direction.

FIG. 14 is a cross section illustrating a further example of the transfer fabric of this invention taken along the direction of wefts. For warps 6, polyamide monofilaments are disposed. For wet paper receiving face side wefts, yarns 7 each obtained by co-twisting two polyamide raising yarns and a crimped yarn_of polyamide multifilaments are disposed. For intermediate layer wefts, polyester monofilaments 8 and polyester mole yarns 9 are alternately disposed. For running face side wefts, yarns 11 each obtained by co-twisting a polyamide monofilament 10, two polyamide raising yarns and a crimped yarn of polyamide multifilaments are disposed, in as twice density as that of the intermediate layer wefts, and in an alternately deviated manner against the intermediate layer wefts. Thus a fabric of eight shafts having single ply of warps and three plies of wefts in a repeating unit is obtained.

Figure 15:
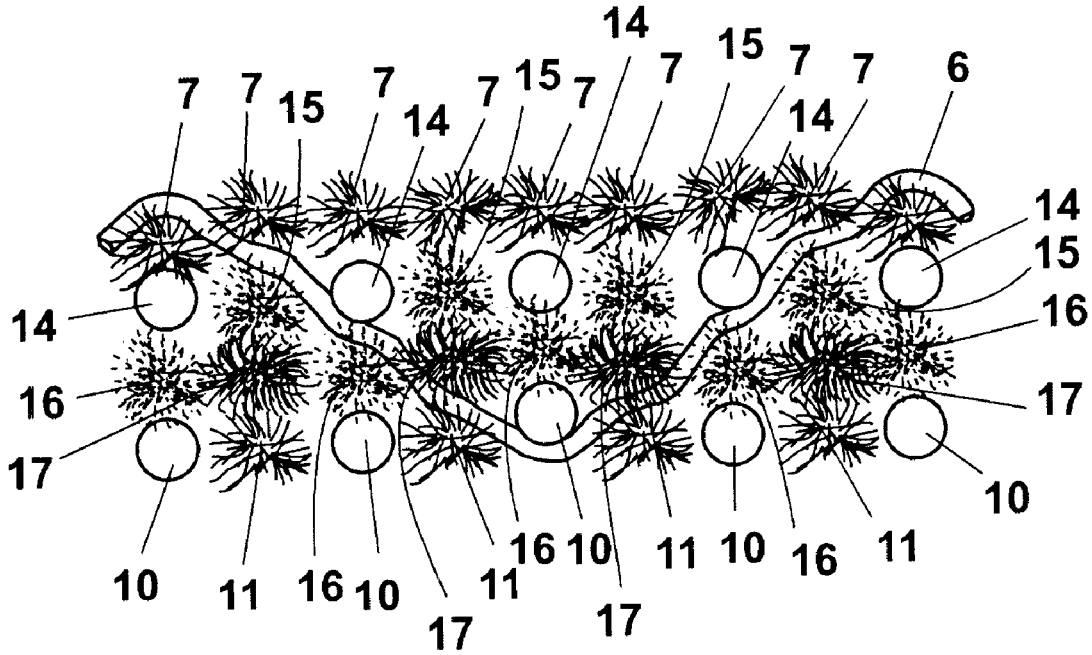
FIG. 15 is a cross section illustrating still another example of the transfer fabric of this invention as taken through the fabric along the warp direction.

FIG. 15 is a cross section illustrating a further example of the transfer fabric of this invention taken along the direction of wefts. For warps 6, polyamide monofilaments are disposed. For wet paper receiving face side wefts, yarns 7 each obtained by co-twisting two polyamide raising yarns and a crimped yarn of polyamide multifilaments are disposed. For upper intermediate layer wefts, polyester monofilaments 14 and yarns 15 obtained by twisting three crimped yarns of polyamide multifilaments are alternately disposed. For lower intermediate layer wefts, yarns 16 obtained by twisting three crimped yarns of polyamide multifilaments and polyamide mole yarns 17 are alternately disposed. For running face side wefts, polyamide monofilaments 10 and yarns 11 each obtained by co-twisting two polyamide raising yarns and a crimped yarn of polyamide multifilaments are alternately disposed. Thus a fabric of eight shafts having single ply of warps and four plies of wefts in a repeating unit is obtained.

In this working example, over running face side monofilaments 10, lower-intermediate layer wefts 16 which are such yarns as are produced by binding plain threads of a small diameter so as to interpose water-absorbing gaps therebetween and upper-intermediate layer monofilament wefts 14 are disposed. Over running face side wefts 11 which are such yarns as are produced by binding plain threads of a small diameter so as to interpose water-absorbing gaps therebetween, lower-intermediate layer wefts 17 which are such yarns as are produced by binding plain threads of a small diameter so as to interpose water-absorbing gaps therebetween and upper-intermediate layer wefts 15 which are such yarns as are produced by binding plain threads of a small diameter so as to interpose water-absorbing gaps therebetween are disposed. Thus, weft rows with wefts 7, 15, 17 and 11 which consist of only such yarns as are produced by binding plain threads of a small diameter so as to interpose water-absorbing gaps therebetween and weft rows with wefts 7, 14, 16 and 10 which contain monofilaments are formed.

Based on the structure above, weft rows which consist of only such yarns as are produced by binding plain threads of a small diameter so as to interpose water-absorbing gaps therebetween play the role to make water mobility smooth from the wet paper receiving side to the running side of the transfer fabric and mobility of water to the running side by means of continuous capillary attraction gaps. The weft rows having monofilaments play the role to improve cushionability, nip resisting property and rigidity of the transfer fabric. Thus, each of the both rows of wefts plays different roles and improves each of the properties effectively.

Next, the meritorious effect of this invention will be described below, by citing the results of a comparative study conducted on the transfer fabrics of the working examples of this invention and the needle felt and the clothed net according to the conventional examples.

Example 1

According to this invention adopted, the working 35 example illustrated in FIGS. 5 and 6 and comparative examples adopted the conventional needle felt and the clothed net of monofilaments tested formerly.

Comparative Example 1

This is a needle felt obtained by intertwining by needling a vat of polyamide at a rate of 1 kg per square meter ($m^2$) of foundation using twisted polyamide monofilaments for warps and polyamide monofilaments for wefts.

Comparative Example 2

This is a 7-shaft woven fabric of the combination of one ply of warps and two plies of wefts, produced by disposing 180 polyester monofilaments, 0.15 mm in diameter, per inch for warps, alternately disposing a total of 96 nylon monofilaments, 0.13 mm in diameter, and polyester monofilaments, 0.17 mm in diameter, per inch for wet paper receiving face side wefts, and alternately disposing a total of 48 polyester monofilaments and polyamide monofilaments, each 0.22 mm in diameter for running face side wefts.

Comparative Example 3

This is a 8-shaft transfer fabric of the combination of one ply of warps and two plies of wefts, which is disclosed in Japanese Patent Application No. 9-238798, produced by disposing 90 polyamide monofilaments, 0.35 mm in diameter, per inch for warps, 28 wet paper receiving face side wefts per inch, each obtained by co-twisting a polyamide raising yarn, 540 deniers each in fineness, and a crimped yarn_of polyamide multifilaments, 800 deniers in fineness, 28 polyester monofilaments, 0.45 mm in diameter, per inch for intermediate layer wefts, and 28 polyester monofilaments and polyamide monofilaments, 0.40 mm in diameter, alternately disposed, per inch for running side face wefts.

Comparative Test

1. Sheet Transfer

Discarded cardboard paper as raw material was processed on a paper forming woven fabric to produce wet paper. In a Tappi Standard Sheet Tester, the sample wet papers of the example and the comparative examples were mounted as inverted on the wet paper receiving face, roll pressed (80 mm in diameter, about 0.75 kg/cm), and then relieved of a paper forming net to find which of the opposed faces the wet paper adhered to.

The transferability was superior in the decreasing order of working example, Comparative Example 3 and Comparative Example 1. The sample of Comparative Example 2 could not be stably transferred.

The paper forming woven fabric used in the test was a 7-shaft combination of one ply of warps and two plies of wefts, having 155 polyester monofilaments, 0.17 mm in diameter, disposed per inch for warps, a total of 86 polyester monofilaments and polyester monofilaments, 0.20 mm in diameter, alternately disposed per inch for wet paper receiving face side wefts, and a total of 43 polyester monofilaments and polyamide monofilaments, 0.22 mm in diameter, alternately disposed per inch for running face side wefts.

2. Property to Resist Shower

The samples of Example 1 and comparative examples were set in frames and exposed to high-pressure shower under the following conditions, and were examined to rate durability to resist the impact of shower.

| | |
|---|---|
| Shower pressure: | 20, 30 kg/cm$^2$ |
| Nozzle diameter: | 1 mm |
| Distance: | 100 mm |
| Sliding distance: | 50 mm in the direction of warps and 50 mm in the direction of wefts |
| Speed of sliding: | 50 mm/30 sec. in the direction of warps and 50 mm/7 sec. |

Under the shower pressure of 20 kg/cm$^2$, the sample of Comparative Example 1 was observed to have sustained a fair number of holes after 20 minutes of the test, sample of Comparative Example 2 showed absolutely no sign of trouble after one hour of the test, and samples of Example 1 and Example 3 were not observed to sustain any discernible rupture or breakage of yarns in spite of slight scuffing in 30 minutes of the test.

Under the shower pressure of 30 kg/cm$^2$, the sample of Comparative Example 1 sustained a hole before completion of one cycle, the sample of Comparative Example 2 showed absolutely no sign of trouble, and the samples of Example 1 and Comparative Example 3 showed no sign of either rupture or breakage of yarn in spite of slight scuffing in 10 minutes of test.

3. Property to Resist Nip

The samples were nipped between two opposed rolls under pressure under the following conditions and rate for fibrillation or disintegration of yarns.

| | |
|---|---|
| Tension: | 2.5 kg/cm |
| Nip roll: | 40 mm (in diameter) × 2 (made of steel and plated with chromium) |
| Nip conditions: | Dry 15 kg/cm |
| Stroke: | 100 mm |
| Sliding speed: | 50 cycles/mm |
| Number of sliding motions: | 15,000 reciprocations |

The sample of Comparative Example 1 suffered a decrease of 36.25% in thickness, though it showed no marked variation in appearance. The sample of Comparative Example 2 sustained fibrillation in the warps and upper and lower polyester monofilaments. It showed a decrease of 4.3 % in thickness.

The samples of Example 1 and Comparative Example 3 showed absolutely no sign of fibrillation but barely suffered a slight crush into a flat face to occur in the yarns obtained by co-twisting raising yarns of polyamide multifilaments and crimped polyamide multifilaments for the wet paper receiving face side wefts. The decrease in thickness was 10. 1% in the case of the Example 1 sample and 8.4% in the case of Comparative Example 3 sample.

Further, a transfer fabric of Example 1 was tested by using a papermaking machine shown in FIG. 2 under the papermaking speed of 400 m/min. It was found that water removal at the base forming part and at a suction box prepared before the press part was satisfactorily made. It was further found that transfer of wet paper from a papermaking fabric to a transfer fabric was smoothly and satisfactorily made without any problem.

Water amount in the wet paper at a transfer point to the press part was about 85% in the case of the needle felt of Comparative Example 1, about 91 % in the case of the transfer fabric of Comparative Example 3 as disclosed in Japanese Patent Application No. 9-238798, and about 87% in the case of Example 1 of the present invention.

It is clearly noted from the test results described above that water removing capability and sheet transfer property of the transfer fabric of this invention are like that of the needle felt and equivalently satisfactory, that shower-resisting property of the transfer fabric of this invention is far more excellent than that of the needle felt, and that nip-resisting property of the transfer fabric of this invention is superior to other Comparative Examples.

The transfer fabric of this invention is capable of receiving stably and satisfactorily the wet paper formed in the sheet forming part from the paper forming woven fabric and then delivering it to the hydro-extracting part as the subsequent step.

It excels in the water removing property, lowers water amount in the wet paper at the point to the hydro-extracting part as the subsequent step, permits addition to the speed of papermaking formation and further prevents paper breakage at the press part.

It excels in the shower-resisting property, allows ready removal of the dirt therefrom by high-pressure shower cleaning, and consequently permits addition to the speed of paper formation.

It further excels in the nip-resisting property and incurs only a sparing decrease in thickness. It shows no sign of degradation in the cushionability and the ability to remove water even after a protracted use and, therefore, maintains a satisfactory sheet transfer property until the termination of service life.

Use of the transfer fabric which manifests satisfactory wet paper-transferring property and cleanability as described above ought to allow accomplishment of the ultimate object of this invention, which resides in enhancing the productivity of paper.

What is claimed is:

1. A transfer fabric for receiving and transferring wet paper in a papermaking machine comprising a running face side and a wet paper receiving face side, wherein first wefts which form first weft layer on the running face side being monofilaments and plain threads so bound as to interpose first water absorbing gaps therebetween, said monofilaments and plain threads are disposed alternately;

second wefts which form second weft layer on the wet paper receiving face side being plain threads so bound as to interpose second water absorbing gaps therebetween; and warps being monofilaments or twisted monofilaments; further wherein said first and second wefts form a plurality of layers woven by said warps.

2. A transfer fabric according to claim 1, wherein said warps comprise first warps and second warps, wherein said warps comprise first and second warps, the first warps which form a first warp layer on the running face side being monofilaments; and the second warps which form a second warp layer on the wet paper receiving face side being monofilaments and/or plain threads so bound as to interpose third water absorbing gaps therebetween; and further wherein said first and second wefts form a plurality of layers and said first and second warps form a plurality of layers.

3. A transfer fabric according to claim 2, wherein said second warps are at least ones selected from a second group consisting of spun yarns, multifilaments, twisted monofilaments, mole yarns, filament-processed yarns, yarns having spun yarns wound on core lines of monofilaments, or yarns having multifilaments wound on core lines of monofilaments; or said second warps are ones produced by co-twisting at least two of the second group.

4. A transfer fabric according to claim 1, wherein said second wefts are at least ones selected from a first group consisting of spun yarns, multifilaments, twisted monofilaments, mole yarns, filament-processed yarns, yarns having spun yarns wound on core lines of monofilaments, or yarns having multifilaments wound on core lines of monofilaments; or said second wefts are ones produced by co-twisting at least two of the first group.

5. A transfer fabric according to claim 1 which receives wet papers from a paper forming woven fabric, said wet papers are formed by a plurality of sheet forming parts, said transfer fabric delivers the wet papers to a hydro-extracting part, said wet papers are sequentially superposed, upon receipt from each of the sheet forming parts, in a plurality of layers on the transfer fabric.

6. A transfer fabric according to claim 1, the transfer fabric further comprises third wefts that forms an intermediate weft layer, which is interposed between the first weft layer and the second weft layer.

7. A transfer fabric according to claim 6, wherein said third wefts comprise at least ones selected from a third group consisting of spun yarns, multifilaments, twisted monofilaments, mole yarns, filament-processed yarns, yarns having spun yarns wound on core lines of monofilaments and yarns having multifilaments wound on core lines of monofilaments; or are ones produced by co-twisting at least two of the third group.

8. A transfer fabric according to claim 7, wherein said third wefts are formed of monofilaments co-twisted by at least ones selected from the group.

9. A transfer fabric are according to claim 6, wherein said third wefts and said first layer wefts arranged in a deviated manner.

10. A transfer fabric according to claim 6, wherein a number of third wefts in said intermediate weft layer is less than a number of wefts in the first and second weft layers.

11. A transfer fabric according to claim 6, wherein number of third wefts is less than the number of first or second wefts.

12. A papermaking machine having a transfer fabric set forth in claim 1 comprising a plurality of sheet forming parts for making a wet paper layer and a hydro-extracting part, wherein each of the wet papers formed by each of the sheet forming parts is transferred onto the transfer fabric at a predetermined location by means of a nip pressure or a contact face pressure sequentially, thereby forming wet paper layers at the predetermined location, wherein said wet paper layers further being transferred to the hydro-extracting part by the transfer fabric.

13. A transfer fabric according to claim 1, wherein said warps form a single layer.

* * * * *